US005931652A

United States Patent [19]

Epworth

[11] Patent Number: 5,931,652

[45] Date of Patent: Aug. 3, 1999

[54] CONTROL SYSTEM FOR A GASEOUS FUEL

[75] Inventor: Larry N. Epworth, Woodbridge, Canada

[73] Assignee: Complete Combusion Services, Ontario, Canada

[21] Appl. No.: 09/062,709

[22] Filed: Apr. 20, 1998

[51] Int. Cl.[6] ..... F23J 7/00

[52] U.S. Cl. ..... 431/3; 431/12; 431/278; 431/281

[58] Field of Search ..... 431/6, 3, 29, 30, 431/31, 278, 281, 12, 60, 62, 63, 2, 8; 126/116 A

[56] References Cited

U.S. PATENT DOCUMENTS

| | | | |
|---|---|---|---|
| 3,369,749 | 2/1968 | Siegmund et al. | 431/12 |
| 4,614,491 | 9/1986 | Welden | 431/60 |
| 4,716,883 | 1/1988 | Johnson | 126/116 A |
| 4,798,531 | 1/1989 | Breckner | 431/12 |
| 4,887,958 | 12/1989 | Hagar | 431/12 |
| 5,685,707 | 11/1997 | Ramsdell et al. | 431/90 |

*Primary Examiner*—Ira S. Lazarus
*Assistant Examiner*—Donna L. Mann
*Attorney, Agent, or Firm*—Shoemaker and Mattare, Ltd.

[57] ABSTRACT

A system is provided for burning gaseous fuel in a burner which defines a first combustion zone and a second combustion zone, the zones being in communication so that materials from one zone can have access to the other. First and second conduits deliver gaseous fuel to the first and second zones, and are provided with first and second flow control valves, respectively. A third conduit allows pressurized air from a source of air to flow through the first combustion zone such as to discourage materials from the second combustion zone from entering the first combustion zone, and a fourth conduit does the same for the second combustion zone. The third and fourth conduits have third and fourth control valves, respectively. A logic device controls the valves, and has a first mode in which one combustion zone receives fuel along the corresponding conduit while simultaneously the other combustion zone receives a flow of pressurized air which is sufficient to discourage entry of materials from the one combustion zone into the other. In a second mode, the reverse takes place.

13 Claims, 4 Drawing Sheets

CONTROL SYSTEM FOR A GASEOUS FUEL

BACKGROUND OF THIS INVENTION

In air make-up and air supply house systems for modern auto plant paint booths, there are three major and persistent operational and maintenance problems:

1. Range and Mode of Modulation
2. Burner System "Fouling"
3. Process Controller and Modulation Speed are "Non Synchronous".

The combination of these problems plays havoc with the process involved and wastes large amounts of energy.

Collectively, air supply systems which feed auto plant paint booths range in total volume from about 750,000 cfm. to 1,250,000 cfm.

A typical air make-up or air supply house system uses a raw gas burner to heat incoming outdoor air to a set point usually in the 68 to 78° F. range. Due to the inherent burner turndown limitations, the traditional burner system cannot provide tight temperature control, especially when the outdoor air temperature is only a few degrees away from the desired discharge temperature. It is not uncommon in these systems to find that the discharge air temperature deviates from the desired set point by 4 to 6° F., and that the energy waste is substantial. The cause of this is inadequate burner turndown and control.

In order to combat this operational problem, split fired burners have been tried on some systems. This arrangement employs a common modular motor mechanically driving (rotating) two flow control valves in unison via a common linkage. In this type of burner configuration, the burner is divided in two. By combining the turndown capability of the two individual sections, the staged burners can provide a somewhat broader turndown range.

However this arrangement has numerous inherent problems. Firstly, at the mechanically "staged" transition point from one section to another, there is produced in all cases either a droop or conversely a spike in the fuel input, depending on whether the system is modulating "up" or "down". The reasons for this are:

A. Flow control valves are inherently non-parabolic and are not well controlled at low velocities. In order to accomplish any semblance of a transition from one section to the other it is necessary for these devices to be deliberately "misadjusted" to taper off flow at the transition point.

B. There is no datum or co-relation of burner staging to that of required heat rise.

C. Modulating motors driving two mechanically linked flow control valves are difficult and cumbersome to adjust. As well, the reaction speed is very slow. For example, to span minimum input to maximum and back to minimum on a 15 second motor would require 30 seconds. Correspondingly, a 2 minute motor would require four minutes, and so on.

It is considered that, in order to eliminate these problems in connection with staged burners, the contemplated system must produce a turn-down ratio of 100 to 1 and must be capable of advancing from minimum to full fire and back to minimum in under 2 seconds. Another consideration is burner fouling. Raw gas burners consist of aeration plates attached to a ported cast iron fuel conduit. The tiny fuel ports (often in the hundreds) begin to reduce in cross-sectional area due to fouling soon after a system is commissioned. This condition reduces the fuel input and correspondingly the heat produced by this section; shortly thereafter, the burner fails to light reliably and the system begins to go down on "flame failure" when the heat requirement of the process is not being met.

The "stop gap" solution for the above problem is a trial-and-error system readjustment of the controls and linkages to increase the modulated fuel flow/pressure to this section to compensate for the fouling.

This condition repeats itself ever more frequently until the burner has to either be removed and replaced, or have the tiny ports re-drilled. Re-drilling is tedious and time-consuming. Aside from the expense involved, if the cross-sectional area of the ports changes to any degree due to the re-drilling, the burner's heat input per lineal foot changes, as does its "turn-down", and this can interfere with keeping the process on set point. Process downtime of course is a major concern to the end users of this equipment.

For some time there has been an awareness of the above fouling phenomenon, which occurs when attempting to increase system turn-down by staging burners. Over the years much research has been conducted into the circumstances surrounding this phenomenon.

It has been observed that fouling tends to occur when the outdoor temperature is such that the Delta T required is within the heat rise capabilities of either burner section operating alone, with the other section turned off. Further, the higher the fuel input of the live burner, the quicker the fouling took place.

Further experimentation revealed the cause of fouling to be the recirculation and the subsequent condensation of spent combustion products within the fuel conduit and ports of the idle burner. The source of these products was the opposite section (the live burner).

AIMS OF THE INVENTION

On the basis of the conclusions reached through the above research and experimentation, it became clear that, in order to eliminate the fouling problem, it was necessary to devise a method and engineer an apparatus that would accomplish the aims set out below, the attainment of such aims being the primary object of this invention:

A. Create within the burner conduit of an idle portion of a burner substantially the same conditions as those found in the firing portion (mock burn condition);

B. Ensure that the mock condition would be omnipresent and capable of "instant" introduction;

C. Be intrinsically opposed from "fire on condition" of any section or sequentially tiered portion which is programmed on to meet the demands of any required process;

D. Integrate and safely interlock with an approved or approvable combustion system; and E. Be suitably interlocked electrically, mechanically, and electronically to prevent air (if that were to be used) from being forced back into the live fuel section, thus preventing a "premixed" fuel-air mixture and conversely raw fuel being emitted from the air inlet. Neither of these potentially dangerous conditions could be tolerated.

GENERAL DESCRIPTION OF THE INVENTION

Accordingly, this invention provides a system for burning a gaseous fuel, comprising:

a burner defining a first combustion zone and a second combustion zone, the zones being in communication such that materials from one zone can have access to the other zone;

a first conduit for delivering gaseous fuel to said first combustion zone;

a second conduit for delivering gaseous fuel to said second combustion zone;

a first flow control valve in said first conduit, a second flow control valve in said second conduit, a source of pressurized air, a third conduit connected to allow pressurized air from said source to flow through said first combustion zone in a direction and at a rate sufficient to discourage materials from said second combustion zone from entering said first combustion zone, a fourth conduit connected to allow pressurized air from said source to flow through said second combustion zone in a direction and at a rate sufficient to discourage materials from said first combustion zone from entering said second combustion zone, a third flow control valve in said third conduit, a fourth flow control valve in said fourth conduit, and means for controlling said flow control valves, said means having a first mode in which one combustion zone can receive gaseous fuel along the corresponding conduit, while simultaneously the other combustion zone receives a flow of pressurized air from said source which is sufficient to discourage entry of materials from said one combustion zone into said other combustion zone, and having a second mode in which said other combustion zone can receive gaseous fuel along the corresponding conduit, while simultaneously said one combustion zone receives a flow of pressurized air from said source which is sufficient to discourage entry of materials from said other combustion zone into said one combustion zone.

Further, this invention provides method for burning a gaseous fuel in a burner which defines a first combustion zone and a second combustion zone, the zones being in communication such that materials from one zone can have access to the other zone; the method comprising the steps:

delivering gaseous fuel to said first combustion zone while simultaneously allowing pressurized air from a source of pressurized air to flow through the second combustion zone in a direction and at a rate sufficient to discourage materials from said first combustion zone from entering said second combustion zone, the flow of pressurized air from said source being maintained below a level at which the pressurized air would force fuel backwards along the conduit intended to supply such fuel to said first combustion zone.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 4:
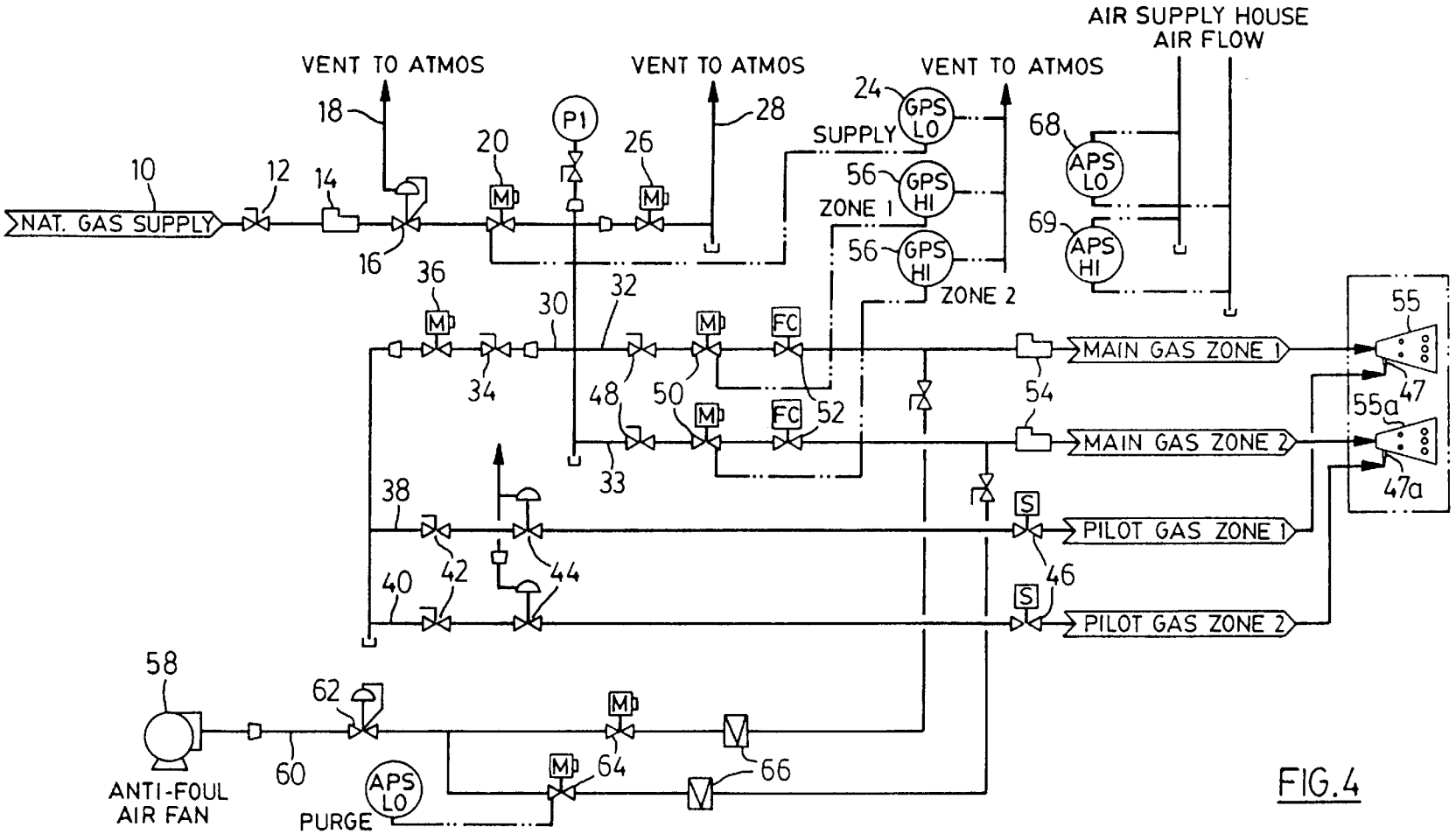
FIG. 4 is a schematic diagram showing the various valves, outlets, and orifices.

Attention is first direct to FIG. 4, which shows the main mechanical components of the control system.

In FIG. 4, the natural gas supply is illustrated at upper left and bears the numeral 10. The natural gas passes through a ball valve 12, a metering orifice 14, a main regulator 16 with a vent 18 to the atmosphere, and a safety shut-off valve 20. The natural gas pressure is monitored by a low gas pressure switch 24. Downstream of the safety shut-off valve 20, the line supplying the natural gas splits into two continuations, the first passing through a vent valve 26 and terminating in a vent 28 to the atmosphere, the second branch extending downwardly (as drawn) and feeding natural gas in both directions along a leftward extension 30 and a rightward extension 32. The leftward extension 30 passes through a ball valve 34, a safety shut-off valve 36, and then connects with two pilot lines 38 and 40. The two pilot lines are identical, and along each the natural gas passes through a full port ball valve 42, thence to a pilot regulator 44. Downstream of the pilot regulators 44, the respective lines pass through two solenoid valves 46, thence downstream to pilots 47 and 47*a*.

Returning now to the rightward branch 32, and an identical such branch 33, it will be seen that each of these passes through a ball valve 48, thence through a motorized blocking valve 50, thence through a QR flow control valve 52, thence through a metering orifice 54, and then onward to respective burner portions 55 and 55*a*.

Each buner (extreme right of FIG. 4) has an open upstream end for receiving gaseous fuel, and a wall portion tapering in the downstream direction. The wall portion has a plurality of apertures through which gaseous fuel can pass.

The gas pressure to the burner is monitored by high gas pressure switches 56.

At bottom left of FIG. 4 is illustrated an anti-foul air fan 58 which includes a filter for incoming air (not illustrated), and which sends pressurized air along a line 60 where it first meets a pressure regulator 62. The line 60 then branches into two portions each conducting the blown air through a respective air shut-off valve 64, thence through an orifice valve 66. The pressurized air line branches terminate against and communicate with the main gas lines at locations intermediate between the respective valve 52 and the respective metering orifice 54.

Figure 1:
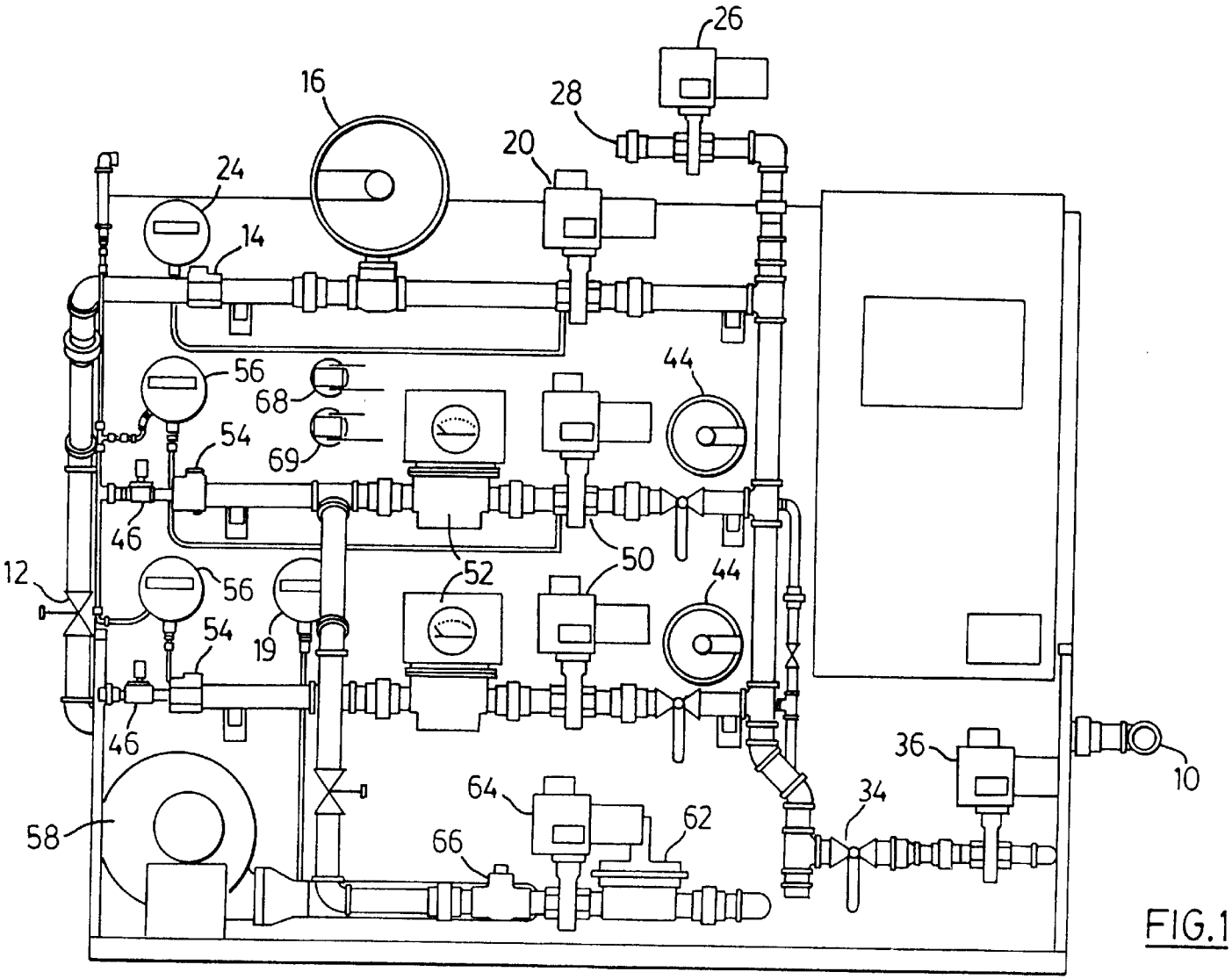
FIG. 1 is an elevational view of a control installation constructed in accordance with this invention.

The various components in FIG. 1 are identified by numerals corresponding to those utilized in FIG. 4.

Figure 2:
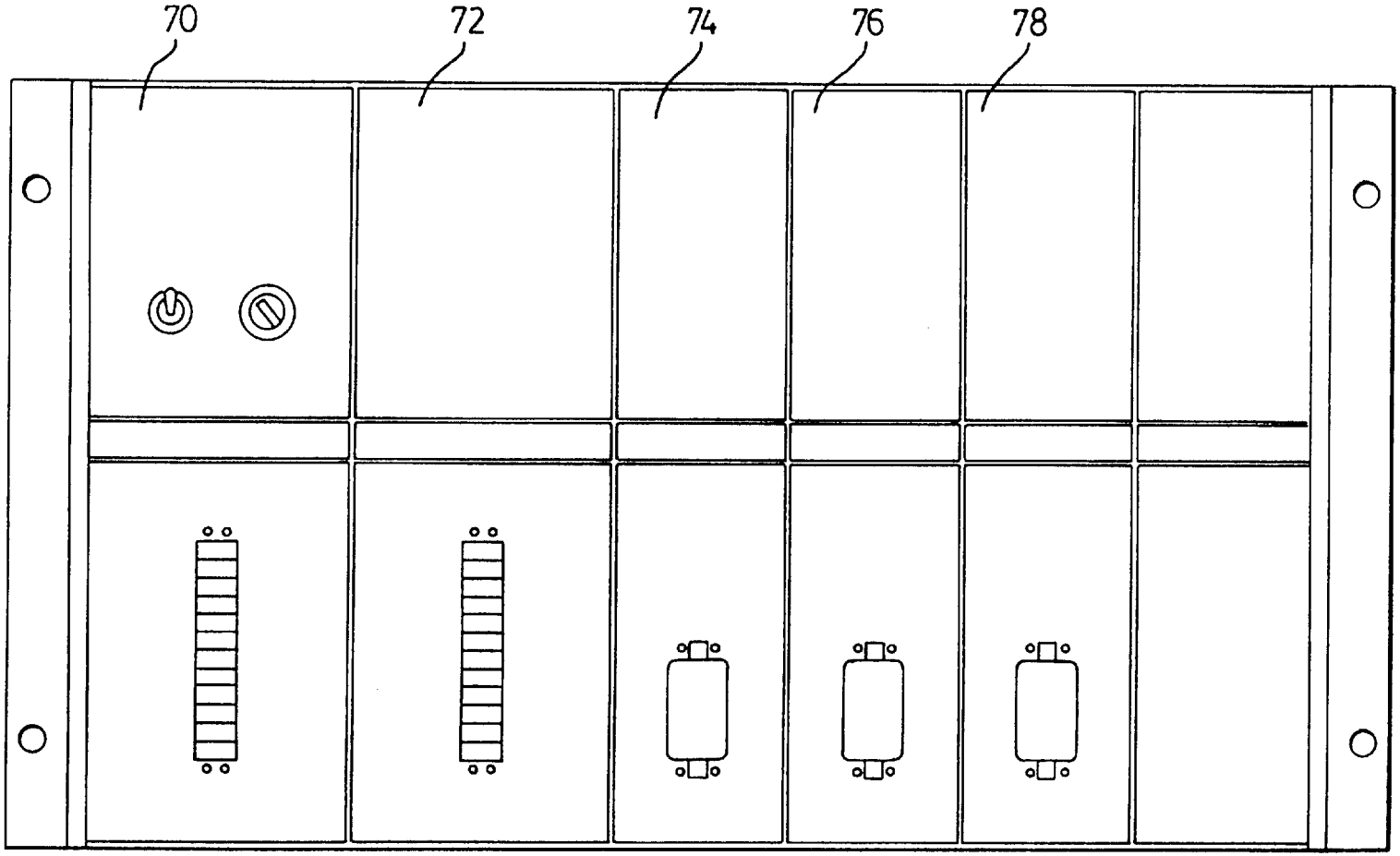
FIG. 2 is an elevational view of a control chassis, showing various modules.
Figure 3:
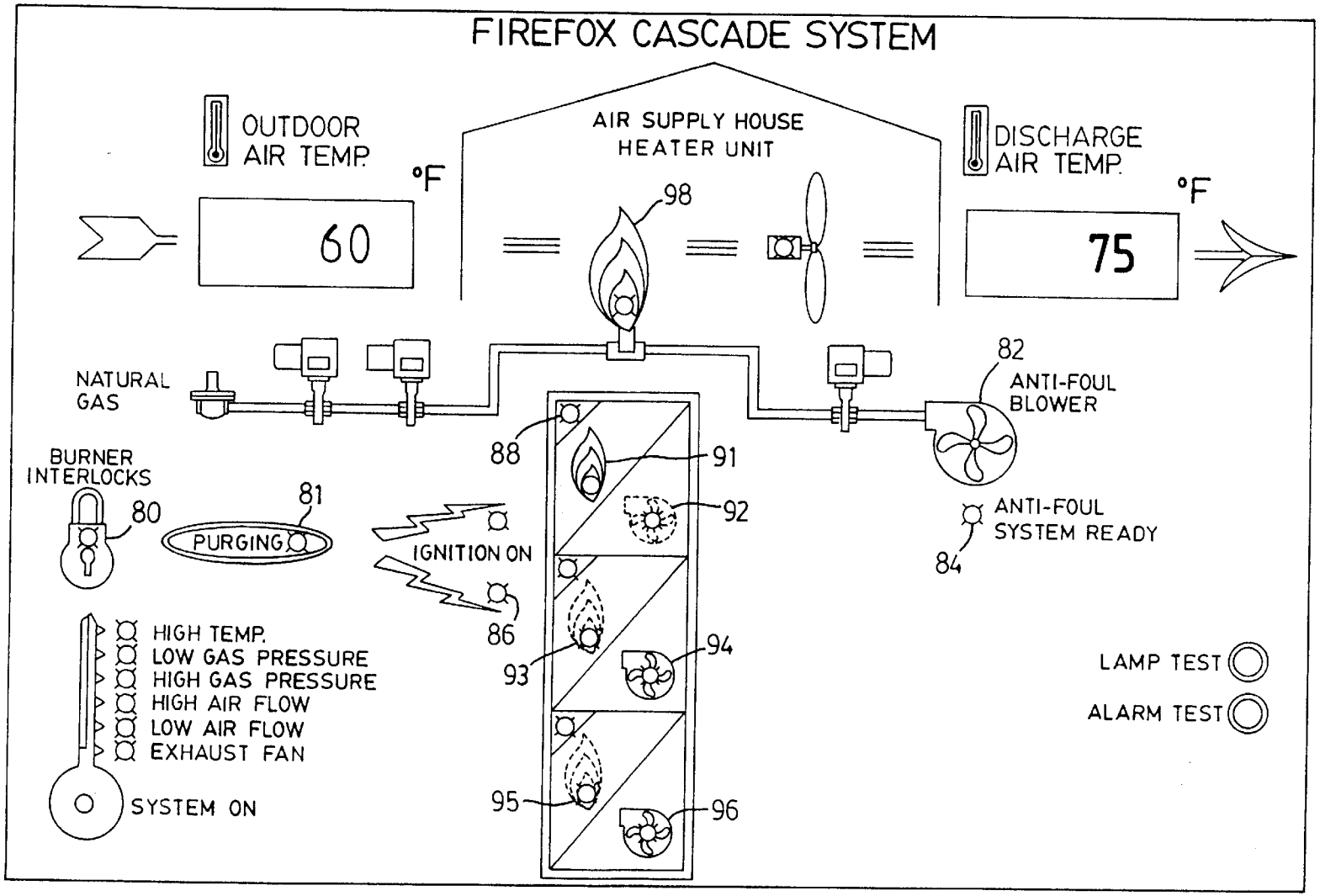
FIG. 3 is a mimic display of the main features of the system in accordance with this invention.

FIGS. 2 and 3 show the electronic control components of the system.

More specifically, FIG. 2 shows the heart of the burner cascade logic control, housed in a 19" rack. It is made up of a power supply module 70, a processor module 72, an input module 74 and output modules 76. The microprocessor in the processor module 72 is custom designed to sequence the burner gas and anti-foul air valves, based on discrete and analog inputs including outdoor and process discharge air temperatures. The burner flame monitoring is handled by standalone burner flame controls.

The graphics mimic display, illustrated in FIG. 3, provides an indication of the status of the system under normal operation, as well as alarm status to assist in troubleshooting. The outdoor air temperature and air supply discharge air temperature are also displayed.

DESCRIPTION OF OPERATION

Burner Start-Up

The burner start-up is monitored by a burner flame control circuit using two Honeywell 7800 series controls. The control system works in the background monitoring the status from the burner controls and valve train components, to provide the control sequence on burner staging and purging.

The burner start-up is fully automated, provided the following safety interlocks are made:

ASH supply air flow above minimum, 68

ASH supply air flow below maximum, 69

Gas header pressure below high limit, 56

Gas header pressure above low limit, 54

ASH discharge air temperature below high limit

Burner flame control not in "Lockout" condition

The corresponding status light and the "Burner Interlocks" light 80 will illuminate on the graphics display. If any one of the interlocks is not satisfied, the corresponding light will flash.

The anti-foul air blower 58 is started and the anti-foul air valves 64 are energized to open. Pressurized purge air is fed to the burner to displace any residue combustion products and condensation. The "anti-foul blower on" light 82 and "anti-foul system ready" light 84 are both illuminated.

The gas safety shut-off valve 20 and pilot safety shut-off valve 36 are energized to open, and gas vent valve 26 is energized to close. Fuel gas is allowed to flow through to the motorized blocking or shut-off valves 50 and to the pilot solenoid valves 46.

The burner flame control initiates a 30 second purge, to displace any residual combustibles in the heater box. The "purging" light 81 will illuminate.

At the end of a 30 second purge, the flame controls initiate "Trial for Ignition". The spark generator and pilot gas valves 46 are energized. Fuel gas is fed to the pilots where the spark ignitor is located. The corresponding "ignition on" light 86 will illuminate on the display shown in FIG. 3.

If the fuel is ignited and the flame is detected, the pilot gas valves 46 remain energized and the "pilot on" light 88 will illuminate on the display. The burner controls will energize the output for the main gas blocking valves 50.

The control system now takes over to provide the logic for burner staging and purging based on the outdoor and discharge air temperatures.

NORMAL OPERATION CONTROL SEQUENCE

Outdoor and Process Discharge Air Temperature above 78° F.

Assume firstly that when the air temperature is above 78° F., additional heat input from the burner is not required. The control system will keep the burner main gas valves closed leaving the pilots on. The anti-foul air valves 64 remain open sending pressurized purge air to the burner sections. This enables the burners to be brought on line immediately as required without going through a lengthy system purge.

Outdoor Air Temperature between 78 and 68° F.

Due to the low heat demand, the control system initiates tier 1 burner operation, i.e. only the lower-capacity burner portion 55 (burner #1) is in firing position.

The burner #1 anti-foul air valve 64 is de-energized to close. Once the air valve is closed, the corresponding gas blocking valve 50 is powered to open. Fuel gas passes through the corresponding blocking valve 50, QR flow control valve 52 and metering orifice 54 to the burner portion 55, where it will be ignited by the pilot flame 47. The "tier 1 burner on" light 91 and "flame on" light 98 will illuminate on the display, and the "tier 1 anti-foul on" light 84*a* will go out. The corresponding quick response flow control valve (QR valve) 52 is modulated to maintain the process discharge temperature.

During tier 1 operation, the anti-foul air valve 64 for burner #2 stays open sending pressurized air to the burner portion 55*a* to keep the nozzles from fouling. The "tier 2 anti-foul" light 92 and the "tier 3 anti-foul" light 94 will illuminate.

Outdoor Air Temperature Falls to between 68 and 30° F.

When ambient temperature drops below 68° F., the system anticipates the need for higher heat input and initiates a switchover from tier 1 to tier 2.

The burner #2 (portion 55*a*) anti-foul air valve 64 is closed and the corresponding gas blocking valve 50 is energized to open. Fuel gas passes through blocking valve 50, QR flow control valve 52 and metering orifice 54 to the burner #2 section, where it will be ignited by the pilot flame 47*a*. The "tier 2 burner on" light 93 and "flame on" light 98 will illuminate on the display, and the "tier 2 anti-foul on" light 92 will go out. The process air temperature control signal is switched over to burner #2 QR flow control valve 52.

As the QR valve can respond very quickly (less than 2 seconds), the typical problem of temperature droop or spike is eliminated.

At the same time, burner #1 (portion 55) gas blocking valve 50 is de-energized stopping gas flow to burner 1. The corresponding anti-foul air valve 64 is powered to open, sending pressurized purge air to burner section #1 (portion 55).

Outdoor Temperature Falls below 30° F.

When outdoor air temperature drops below 30° F., the control system starts the switchover sequence to tier 3 operation, in which both burners 1 and 2 are put into operation to provide maximum heat input.

The burner #1 anti-foul air valve 64 is closed and the corresponding gas blocking valve 50 is energized to open, reestablishing main flame. The "tier 3 burner on" light 95 will illuminate. The burner #1 QR flow control valve 52 is then locked on "high fire", while the burner #2 QR valve stays in modulation. Once the gas valves are proven open, the anti-foul air blower is switched off to conserve energy since "anti-foul" purge air is not required. The "tier 3 anti-foul on" light 96 will go out.

The reverse sequence takes place as the outdoor temperature rises.

SYSTEM SAFEGUARD

The cross feeding of anti-foul air and fuel gas could lead to a potentially dangerous condition in which a "premix" fuel-air mixture is sent to the raw gas burner or gains access to the building through the air inlet.

To eliminate any possibility of these dangerous conditions, the control system is designed to utilize two levels of safeguards: in the hardwired circuit and in the processor control logic.

The first level of safeguard is to hardwire the valve "proof of closure" switch in the corresponding valve enable circuit. In other words, the gas blocking valve will not be energized until the corresponding anti-foul air valve is proven closed and vice versa, i.e., the anti-foul air valve will not be energized until its corresponding gas blocking valve is closed.

To provide a second level safeguard, the control processor monitors an independent "proof-of-closure" switch on all of the anti-foul air and gas blocking valves. If the control system detects the gas valve open signal prior to the air valve "proof-of closure" signal or the air valve open signal prior to the gas valve "proof of closure" signal, the burners will be shut down. This will trip the main gas valves and open the anti-foul air valves. The corresponding air valve or gas valve open light will flash to indicate the fault condition.

In the event that the system microprocessor detects an internal fault, the watchdog timer will initiate a fail-safe shutdown, disabling all the control output signals. The "system on" LED will flash to indicate processor fault. Resetting the processor is accomplished by switching system power off.

While one embodiment of this invention has been illustrated in the accompanying drawings and described hereinabove, it will be evident to those skilled in the art that changes and modifications may be made therein, without departing from the essence of this invention as set forth in the appended claims.

I claim:

1. A system for burning a gaseous fuel, comprising:

a burner defining a first combustion zone and a second combustion zone, the zones being in communication such that materials from one zone can have access to the other zone;

a first conduit for delivering gaseous fuel to said first combustion zone;

a second conduit for delivering gaseous fuel to said second combustion zone;

a first flow control valve in said first conduit, a second flow control valve in said second conduit, a source of pressurized air, a third conduit connected to allow pressurized air from said source to flow through said first combustion zone in a direction and at a rate sufficient to discourage materials from said second combustion zone from entering said first combustion zone, a fourth conduit connected to allow pressurized air from said source to flow through said second combustion zone in a direction and at a rate sufficient to discourage materials from said first combustion zone from entering said second combustion zone, a third flow control valve in said third conduit, a fourth flow control valve in said fourth conduit, and means for controlling said flow control valves, said means having a first mode in which one combustion zone can receive gaseous fuel along the corresponding conduit, while simultaneously the other combustion zone receives a flow of pressurized air from said source which is sufficient to discourage entry of materials from said one combustion zone into said other combustion zone, and having a second mode in which said other combustion zone can receive gaseous fuel along the corresponding conduit, while simultaneously said one combustion zone receives a flow of pressurized air from said source which is sufficient to discourage entry of materials from said other combustion zone into said one combustion zone.

2. The system claimed in claim 1, in which the third conduit delivers pressurized air to a location in said first conduit which lies intermediate the first control valve and said first combustion zone, and in which the fourth conduit delivers pressurized air from said source to a location in said second conduit which lies intermediate the second control valve and said second combustion zone.

3. The system claimed in claim 1, in which said means has a third mode in which the flow control valves in the first and second conduits remain closed, while the flow control valves in the third and fourth conduits remain open, thus keeping both combustion zones in a state of constant purge.

4. The system claimed in claim 3, in which said means has a fourth mode in which the flow control valves in the first and second conduits remain open, while the flow control valves in the third and fourth conduits remain closed, thus burning gaseous fuel in both combustion zones simultaneously.

5. The system claimed in claim 4, in which the third conduit delivers pressurized air to a location in said first conduit which lies intermediate the first control valve and said first combustion zone, and in which the fourth conduit delivers pressurized air from said source to a location in said second conduit which lies intermediate the second control valve and said second combustion zone.

6. The system claimed in claim 1, wherein said means ensures that the rate at which either combustion zone receives the flow of pressurized air from said source is maintained below a level at which the pressurized air would force fuel backwards along the conduit intended to supply such fuel to the other combustion zone.

7. The system claimed in claim 5, wherein said means ensures that the rate at which either combustion zone receives the flow of pressurized air from said source is maintained below a level at which the pressurized air would force fuel backwards along the conduit intended to supply such fuel to the other combustion zone.

8. The system claimed in claim 1, in which each combustion zone has associated therewith a burner portion having an open upstream end for receiving gaseous fuel, and a wall portion tapering in the downstream direction, the wall portion having a plurality of apertures through which gaseous fuel can pass.

9. The system claimed in claim 1, in which the maximum rate at which fuel can be delivered to the first combustion zone is different from that at which fuel can be delivered to the second combustion zone.

10. The system claimed in claim 8, in which the maximum rate at which fuel can be delivered to the first combustion zone is different from that at which fuel can be delivered to the second combustion zone.

11. A method for burning a gaseous fuel in a burner which defines a first combustion zone and a second combustion zone, the zones being in communication such that materials from one zone can have access to the other zone; the method comprising the steps:

delivering gaseous fuel to said first combustion zone while simultaneously allowing pressurized air from a source of pressurized air to flow through the second combustion zone in a direction and at a rate sufficient to discourage materials from said first combustion zone from entering said second combustion zone, the flow of pressurized air from said source being maintained below a level at which the pressurized air would force fuel backwards along the conduit intended to supply such fuel to said first combustion zone.

12. The method claimed in claim 11, in which the first combustion zone is adapted to burn fuel at a maximum rate which is smaller than the maximum rate at which the second combustion zone is adapted to burn fuel, the method further including:

a) when the total output requirement exceeds that of the first combustion zone alone, but is less than that of both combustion zones together: 1) halting the delivery of pressurized air to said second combustion zone and thereafter starting the delivery of gaseous fuel to said second combustion zone, and 2) halting the delivery of gaseous fuel to said first combustion zone and thereafter starting the delivery of pressurized air to said first combustion zone;

b) when the total output requirement exceeds that of the second combustion zone alone: halting the delivery of pressurized air to said first combustion zone and thereafter starting the delivery of gaseous fuel to said first combustion zone, while maintaining the delivery of gaseous fuel to said second combustion zone.

13. The method claimed in claim 11, in which the delivery of gaseous fuel to the first and second combustion zones takes place along a first and a second conduit, respectively; the first and second conduits having first and second closure valves respectively, and in which the delivery of pressurized air to said combustion zones is accomplished by admitting the pressurized air to the respective conduits at locations lying between the respective control valve and the respective combustion zone.

* * * * *

UNITED STATES PATENT AND TRADEMARK OFFICE

CERTIFICATE OF CORRECTION

PATENT NO. : 5,931,652

DATED : August 3, 1999

INVENTOR(S) : Larry N. Epworth

It is certified that error appears in the above-identified patent and that said Letters Patent is hereby corrected as shown below:

Column 5, line 60, change "84a" to --92--.

Column 5, line 66, change "92" to --94--.

Column 5, line 66, change "94" to --96--.

Column 6, line 12, change "92" to --94--.

Signed and Sealed this

Eleventh Day of July, 2000

*Attest:*

Q. TODD DICKINSON

*Attesting Officer*

*Director of Patents and Trademarks*